US007431482B1

(12) United States Patent
Morgan et al.

(10) Patent No.: US 7,431,482 B1
(45) Date of Patent: Oct. 7, 2008

(54) MODULAR DOWNLIGHT ASSEMBLY

(75) Inventors: David Morgan, London (GB); Dun Ping Hu, Queens, NY (US)

(73) Assignee: W.A.C. Lighting Co., Garden City, NY (US)

( * ) Notice: Subject to any disclaimer, the term of this patent is extended or adjusted under 35 U.S.C. 154(b) by 135 days.

(21) Appl. No.: 11/471,967

(22) Filed: Jun. 21, 2006

Related U.S. Application Data

(60) Provisional application No. 60/692,346, filed on Jun. 21, 2005.

(51) Int. Cl.
*F21V 17/00* (2006.01)
*F21V 21/14* (2006.01)
*F21V 19/02* (2006.01)

(52) U.S. Cl. ..... 362/364; 362/250; 362/285; 362/371

(58) Field of Classification Search ..... 362/364, 362/365, 371, 147, 148, 150, 238, 239, 240, 362/241, 249, 250, 269, 270, 275, 285, 404, 362/418, 419, 425, 426, 427, 428, 145, 362, 362/367, 368, 372, 405, 406, 647, 237, 366, 362/429, 449
See application file for complete search history.

(56) References Cited

U.S. PATENT DOCUMENTS

| | | | | | |
|---|---|---|---|---|---|
| 510,317 | A * | 12/1893 | Berry | ..... | 248/277.1 |
| 3,579,184 | A | 5/1971 | Forstal | | |
| 3,660,651 | A * | 5/1972 | Miles, Jr. | ..... | 362/366 |
| 3,974,371 | A | 8/1976 | Miles | | |
| 4,232,361 | A * | 11/1980 | Kelsall | ..... | 362/364 |
| 4,881,157 | A * | 11/1989 | Pahl | ..... | 362/371 |
| 4,941,718 | A | 7/1990 | Alexander et al. | | |
| 5,261,645 | A | 11/1993 | Huffman | | |
| 5,366,203 | A | 11/1994 | Huffman | | |
| 5,379,977 | A | 1/1995 | Ronn | | |
| D395,909 | S | 7/1998 | Moss et al. | | |
| 6,345,799 | B1 | 2/2002 | Fusi | | |
| 6,561,683 | B1 * | 5/2003 | Jachno | ..... | 362/371 |
| 6,637,711 | B2 | 10/2003 | Enochs | | |
| 6,997,574 | B2 * | 2/2006 | Kotovsky | ..... | 362/147 |
| 2003/0010967 | A1 | 1/2003 | Enochs | | |

* cited by examiner

*Primary Examiner*—Hargobind S. Sawhney
*Assistant Examiner*—David R Crowe
(74) *Attorney, Agent, or Firm*—Robert W. J. Usher

(57) ABSTRACT

A modular downlight assembly having a channel shaped back housing for mounting in a ceiling cavity and formed with a series of identical apertures receiving, respectively, when mounted in the cavity, selected similar individual downlight modules. Each module has a mounting plate with a power supply mounted on an upper back face received, concealed from view, in an aperture and a lamp housing pivotally suspended from a turnable on a lower face by a scissor linkage for extension and retraction out of and into the housing channel. A protractor for indicating rotational direction is marked on the lower face of the mounting plate. Meshed gear teeth are provided on endmost links of the two linkages of each scissor link, synchronizing their movement. Selected links have movement limiting flanges extending into paths of movement of adjacent links and of the lamp housing limiting extension, pivotal movement and rotation.

20 Claims, 10 Drawing Sheets

MT-MR16

MT-CDMPAR38

MT-PAR38

MT-CDMT6

MODULAR DOWNLIGHT ASSEMBLY

RELATED APPLICATIONS

Priority is claimed from my provisional application 60/692,346, filed Jun. 21, 2005, the disclosure of which is incorporated herein by reference.

FIELD OF THE INVENTION

The invention relates to a modular down light assembly and, in particular, to a modular downlight assembly in which a lamp holder housing is suspended in a back housing in a ceiling cavity from an extensible scissor/toggle type linkage, extension and contraction of which permits the lamp to be pulled down and pushed up, respectively, between positions exposed below the housing and relatively concealed within the housing, for aiming and different lighting effects.

BACKGROUND OF THE INVENTION

U.S. Pat. No. 3,660,651 issued 1972 to Miles, the disclosure of which is incorporated herein by reference, teaches an adjustable downlight assembly comprising a lamp holder housing suspended in a back housing in a ceiling cavity by a scissor/toggle type linkage, extension and contraction of which permits the lamp to be pulled down and pushed up, respectively, between lower and upper positions exposed below the housing and relatively concealed within the housing, respectively, for lamp aiming and different lighting effects.

The prior lamp holder housing may also be rotated about a vertical axis and the shade/reflector pivoted about a horizontal axis.

However, Miles does not teach the concept of modularity enabling any selected variable number of closely similar downlight assemblies to be mounted in a single back housing in a ceiling cavity or, means permitting the selective addition and removal of a downlight assembly by ready access only from below the ceiling while the back housing remains mounted in the ceiling cavity. In addition, Miles does not make provision for an individual power supply, such as a transformer or ballast, incorporated with each module assembly, as extremely desirable for achieving modularity. Furthermore, Miles does not teach any means built in a downlight assembly for determining a precise angle of rotation about the vertical or horizontal axes for ease of aiming adjustment and calibration, nor for adequately limiting the pivotal movement of the lamp holder housing independently of engagement with the back housing or cabling.

SUMMARY OF THE INVENTION

An object of the invention is to provide a modular downlight assembly enabling a selected variable number of essentially similar downlight assemblies to be mounted in or removed from a single back housing by ready access from below, permitting the selective addition and removal of individual downlight assemblies while the back housing remains mounted in the ceiling cavity.

Another object of the invention is to provide modular downlight assemblies each incorporating an individual, dedicated power supply, which may vary according to the type of lamp, preferably incorporated in a unitary structure for mounting in and removal from the back housing as a single unitary body with the remainder of the downlight without need for additional assembly/disassembly steps.

An additional object of the invention is to incorporate angular scales or protractors in each individual modular downlight assembly to enable the user to readily select a precise angular position of rotation for the lamp.

A further object of the invention is to provide means on the downlight assembly for limiting the pivotal movement of the reflector/lamp holder independently of engagement with the back housing or cabling.

Another object of the invention is to provide a modular downlight assembly having an extensible dual toggle/scissor linkage wherein respective adjacent pivotal ends of uppermost arms of a dual linkage are provided with gear teeth in meshing engagement to ensure that both those uppermost arms move at the same angular rate during lowering or raising the lamp for smoothly progressive extension and retraction of the dual toggle linkage to lower or raise the lamp.

According to one aspect of the invention, a modular downlight assembly comprises:

- a back housing having a frame of inverted channel section with opposite sidewalls extending downwards from opposite sides of a channel base wall so that free, lower ends of the sidewalls define a channel mouth and for mounting in a cavity formed in a ceiling or dropped ceiling with the sidewalls and base concealed/recessed within the cavity and the channel mouth opening to below the ceiling;
- and a plurality of apertures of a same size as each other formed in the base wall for receiving, respectively, selected individual downlight modules when mounted in the cavity;
- respective down light module attachment/fastening means on the base wall at a same location for each aperture;
- a plurality of downlight modules each comprising a lamp holder housing suspended from a lower face of a mounting plate by an extensible scissor/toggle linkage;
- the mounting plates all having module attachment/fastening means at a same location for registration of a mounting plate of a selected module with any selected one of the module attachment/fastening means of the back housing;
- each downlight module comprising a junction box mounted to an upper face of each mounting plate and preferably carrying a power supply, being one of a transformer and a ballast, the junction boxes and power supplies of all modules being within a cross-sectional envelope smaller than any of the apertures in the back housing base wall and
- the mounting plates being sized for engagement with the base wall at edge portions of respective apertures so as to cover respective apertures when the attachment/fastening means are engaged to mount the selected modules in the back housing with the power supply extending through the aperture above the base into the ceiling cavity;
- whereby a selected, variable, number of modules can be mounted individually in a back housing which has been installed in a ceiling cavity by inserting, from below, the junction box and power supply through a selected aperture until a respective mounting plate is brought into covering relation with a respective aperture and the attachment/fastening means thereof are brought into registration and operatively engage with respective downlight module attachment/fastening means on the base wall; and whereby a selected, variable, number of modules can be demounted/removed individually from the back housing remaining installed in a ceiling cavity from below by disengaging said attachment/fastening means and withdrawal of the respective junction boxes and power supplies through the respective apertures.

It will be appreciated that it is also necessary to connect and disconnect power wiring between the power supplies of individual modules and the back housing.

Thus, mounting and removal of any selected number of modules from the back housing can be carried out from below enabling the back frame to remain mounted installed in the ceiling.

The lamp holder housing and the mounting plate are provided with electrical lead receiving apertures through which power leads extend from the lamp base to the junction box.

The fastening attachment/means may comprise fastening screw receiving apertures in the mounting plates and base wall, registerable to receive fastening screws from below.

The scissor/toggle linkage comprises a dual linkage with two chains of links extending in a zig-zag configuration with lowermost end links pivotally connected, at lowermost ends, together and to the lamp holder housing for pivotal movement of the lamp about a horizontal axis and each having an uppermost link having an uppermost end pivotally mounted at adjacent locations to the mounting plate the uppermost ends of the uppermost links being formed with respective gear teeth which are meshed so that the links move together at a same angular rate during extension or retraction of the linkage to lower or raise the lamp.

A link of one chain intersects and is pivotally connected to a link of the other chain for improved synchronous movement and stabilization of the linkages.

Two similar dual linkages may extend between the lamp holder housing and the mounting plate, each dual linkage extending on an opposite side of the lamp holder from the other and the lowermost link may be formed with a motion limiting flange which protrudes into the path of pivotal movement of the lamp holder housing thereby to limit the pivotal movement of the lamp holder housing. Additionally, selected motion limiting flanges may be provided on selected links of respective chains to prevent excessive relative movement thereof.

Preferably, a plate-form turntable comprises a lower plate mounted on the lower face of the mounting plate for rotation about a vertical axis and the uppermost links of respective linkages are pivotally mounted on the turntable to enable rotation of the lamp about a vertical axis.

The perimeter of the turntable may be provided with eccentric stop surfaces aligned for engagement with stop pins staked in the mounting plate to limit rotation of the turntable to prevent damage to the lamp lead.

The lower surface of the mounting plate may be marked with angles of rotation as a protractor.

The plate-form turntable may comprise rotation controlling means comprising a perimetrically toothed annulus and a tooth engaging detent mounted cooperatively on an upper face of the mounting plate and joined though the mounting plate to the lower plate, so that the detent successively engages and releases successive teeth during rotation to provide a tensioning effect and enable precise, incremental rotational positioning of the lamp.

Suitably, the junction box is mounted on a platform mounted, in spaced apart relation on the upper face of the module mounting plate providing clearance for the rotation controlling means received therebetween.

In another embodiment, a non-planar leaf spring may be compressed between the mounting plate and the turntable to provide frictional resistance to rotation of the turntable.

BRIEF DESCRIPTION OF THE DRAWINGS

In order that the invention may be readily understood, specific embodiments thereof will now be described with reference to the accompanying drawing in which.

DESCRIPTION OF PARTICULAR EMBODIMENTS

Figures 1, 2:
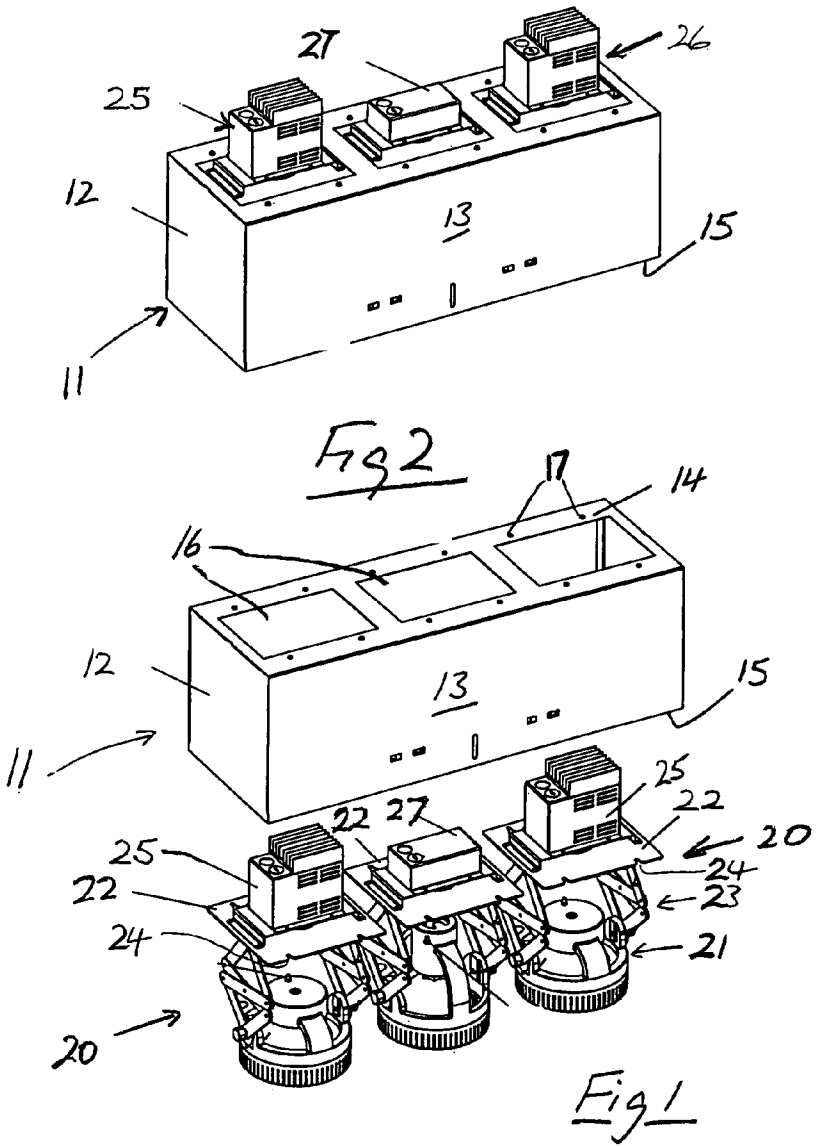
FIG. 1 is a schematic perspective view of different downlight assembly modules aligned with a back housing for mounting therein.
FIG. 2 is a schematic perspective view of the downlight assembly modules of FIG. 1 mounted in the back housing.
Figure 3:
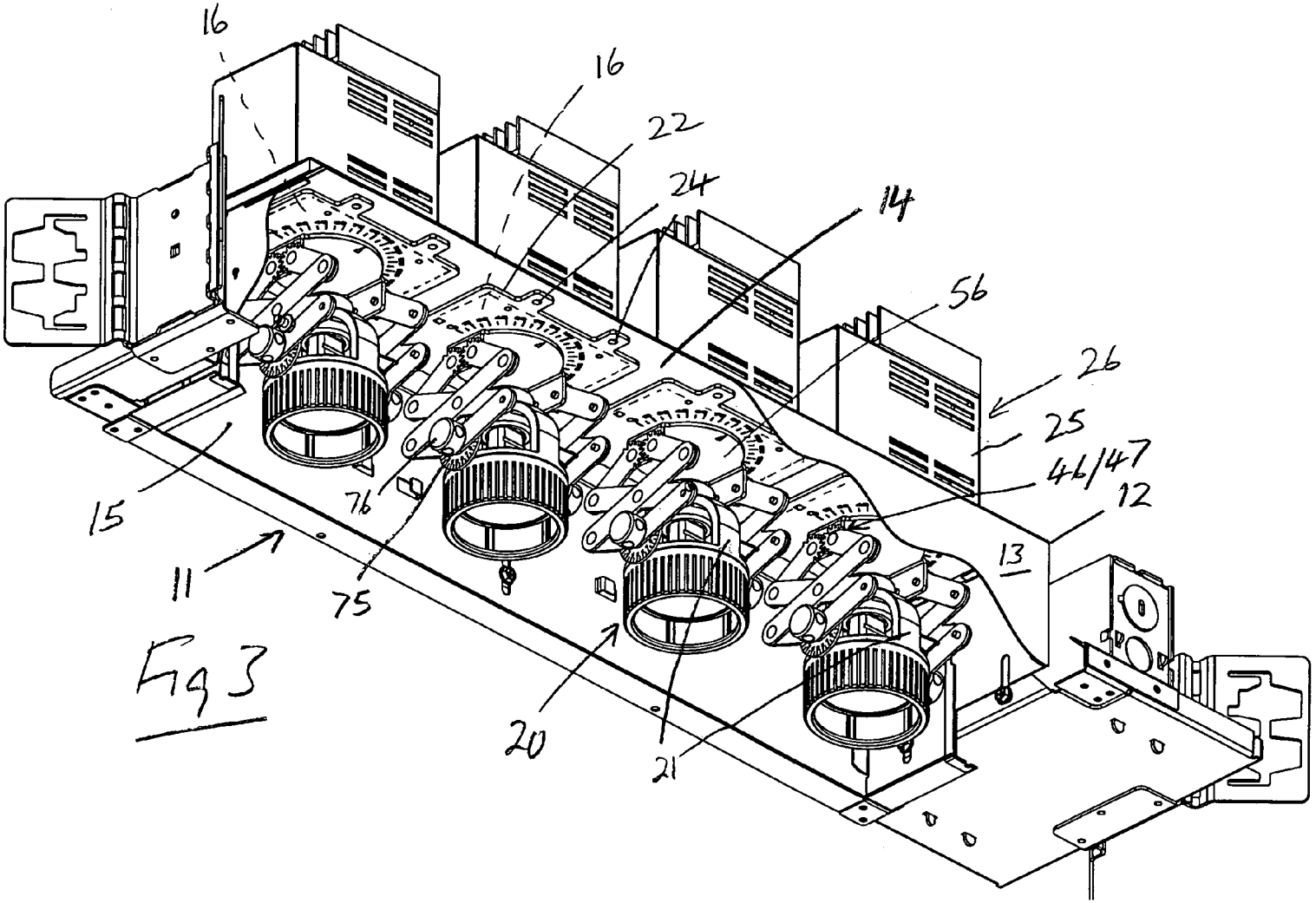
FIG. 3 is a perspective view, partly broken away of a series of four identical downlight assembly modules mounted in a four way back housing with scissor linkages thereof in a withdrawn position so that the lamp assemblies lie totally within the housing profile.
Figure 4:
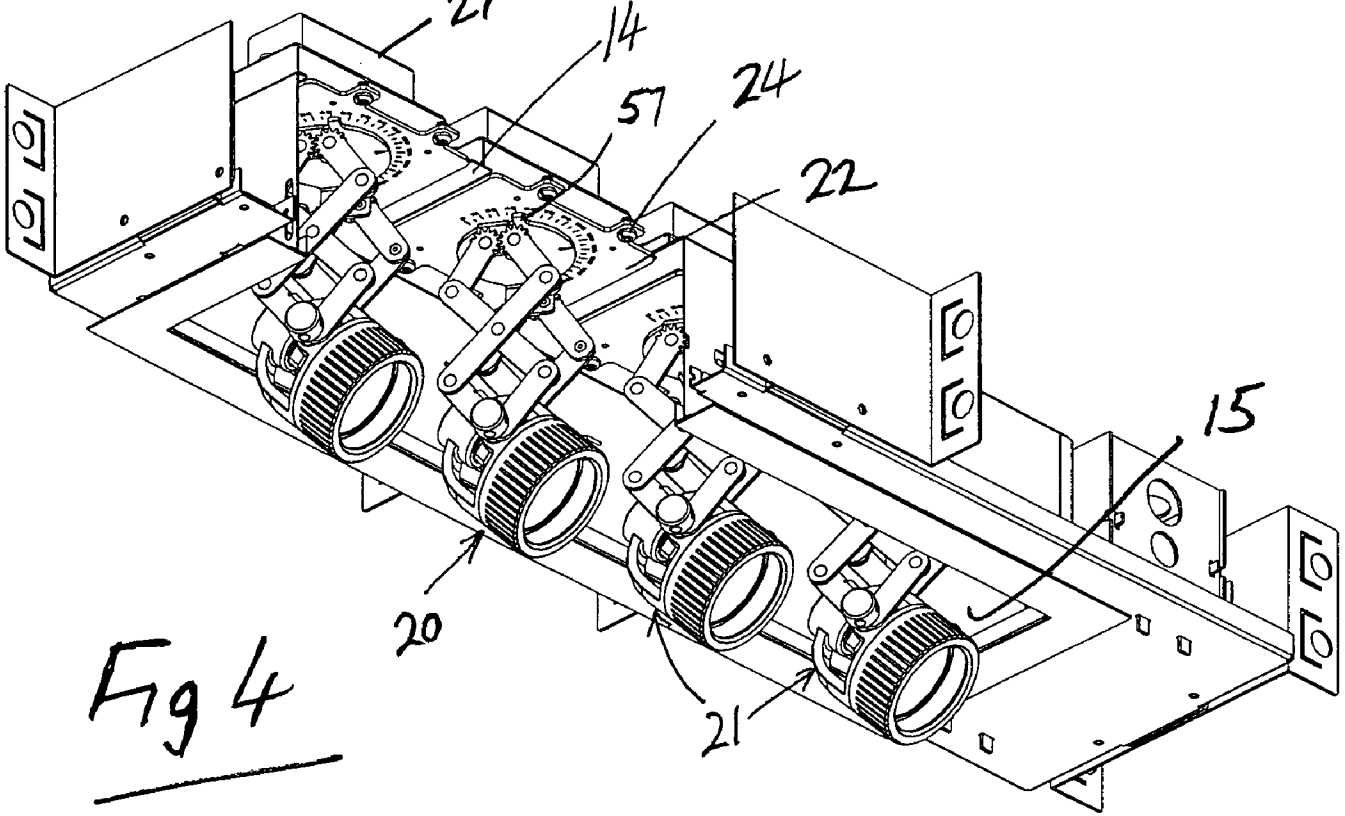
FIG. 4 is a perspective view, partly broken away of a series of four identical downlight assembly modules mounted in a four way, in line, back housing with scissor linkages thereof extended so that the lamps are suspended below the housing.

As shown in FIGS. 1-4, a modular downlight assembly comprises a back housing 11 having a frame 12 of inverted channel section with opposite sidewalls 13 extending downwards from opposite sides of a channel base wall 14 so that free, lower ends of the sidewalls define a channel mouth 15 for mounting in a cavity (not shown) formed in a ceiling or dropped ceiling with the sidewalls and base concealed/recessed within the cavity and the channel mouth opening to below the ceiling cavity. A plurality of apertures 16 of a same size as each other are formed in the base wall 14 for receiving, respectively, selected individual downlight modules 20 while the back housing 11 is mounted in the cavity. The base wall 14 has respective down light module attachment/fastening means 17 (screw holes) at a same location for each aperture 16.

Figure 5:
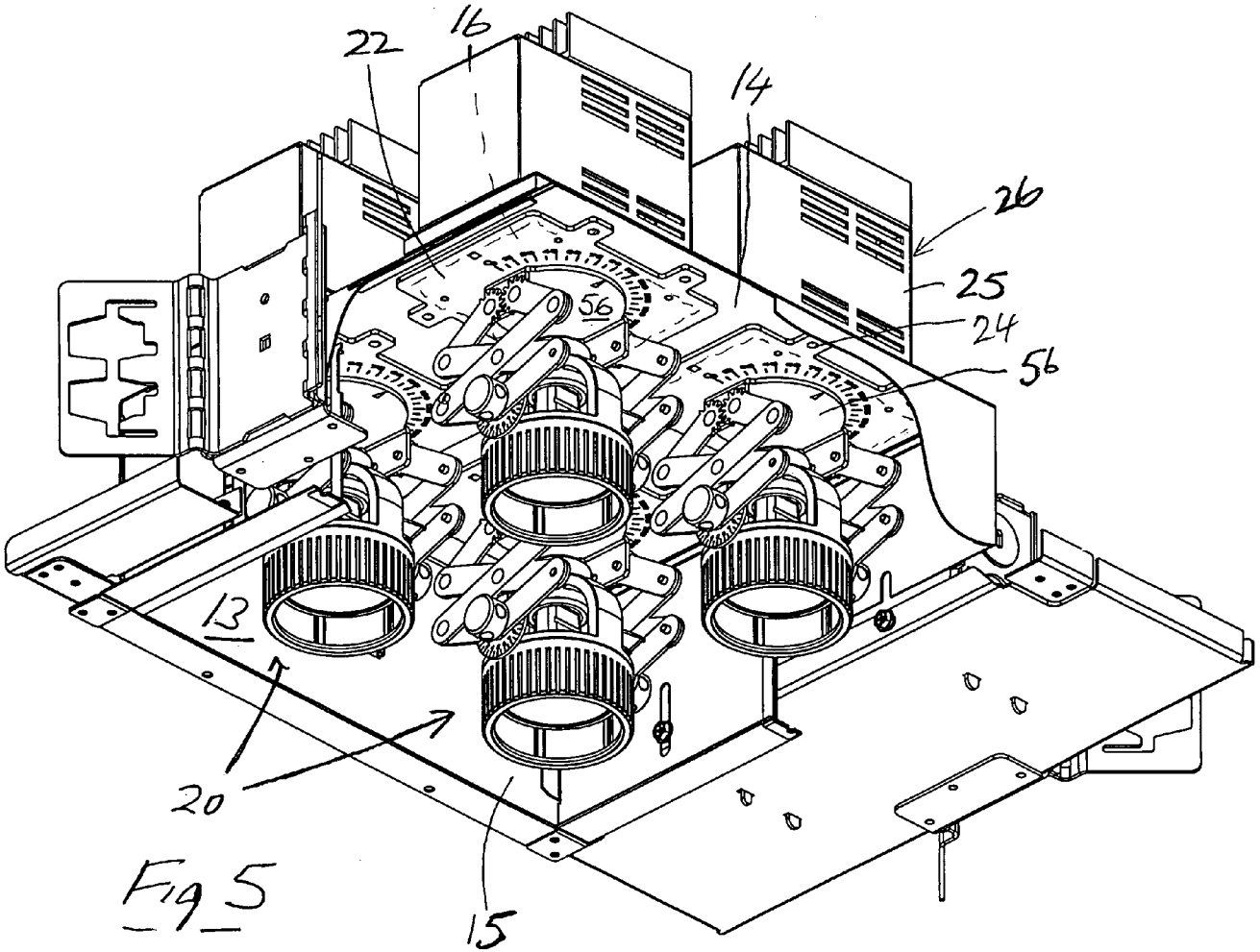
FIG. 5 is a similar view to FIG. 3 showing a series of four identical downlight assembly modules mounted in a four way, square, matrix form back housing.
Figure 7:
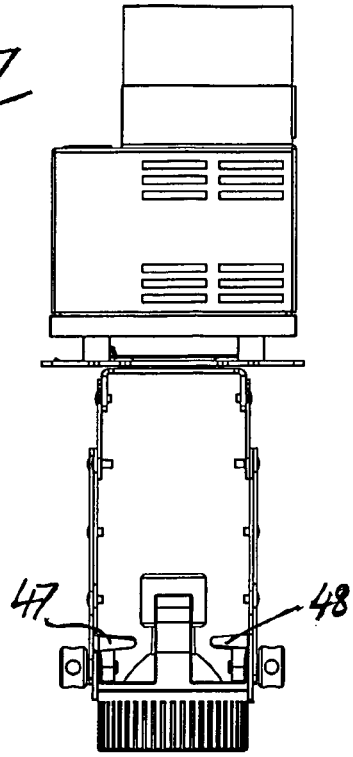
FIGS. 6-8 are perspective, and elevational views of respective orthogonal sides of another embodiment of a downlight assembly module with the scissor linkage in an extended position showing particularly lamp rotation limiting flanges on lowermost links.
Figure 8:
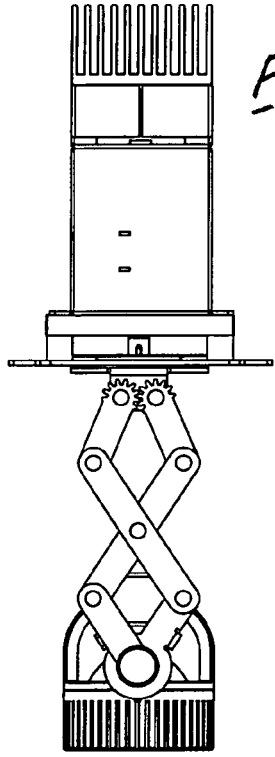
Figure 6:
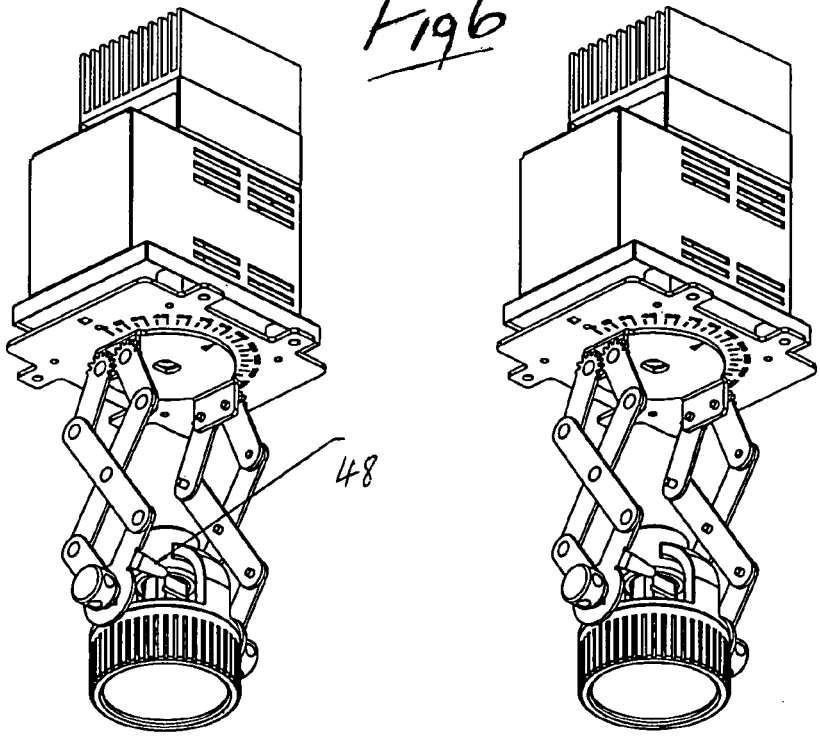
Figure 10:
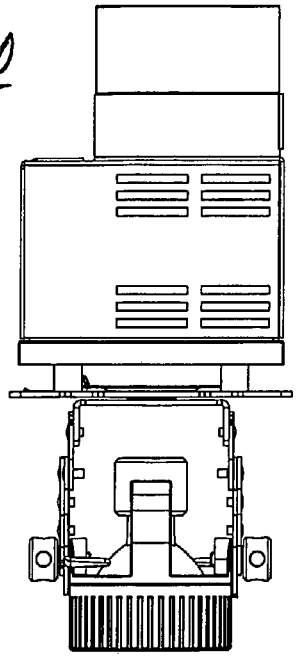
FIGS. 9-11 are perspective, and elevational views of respective orthogonal sides of another embodiment of a downlight assembly module with the scissor linkage in an retracted position.
Figure 11:
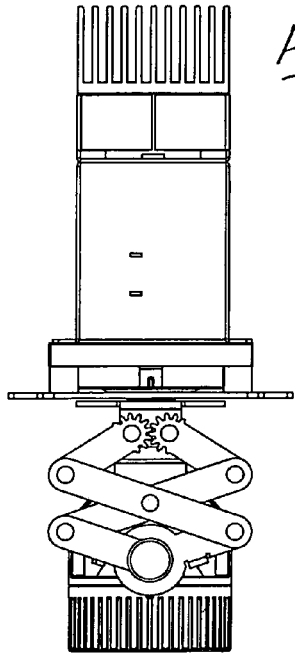
Figure 9:
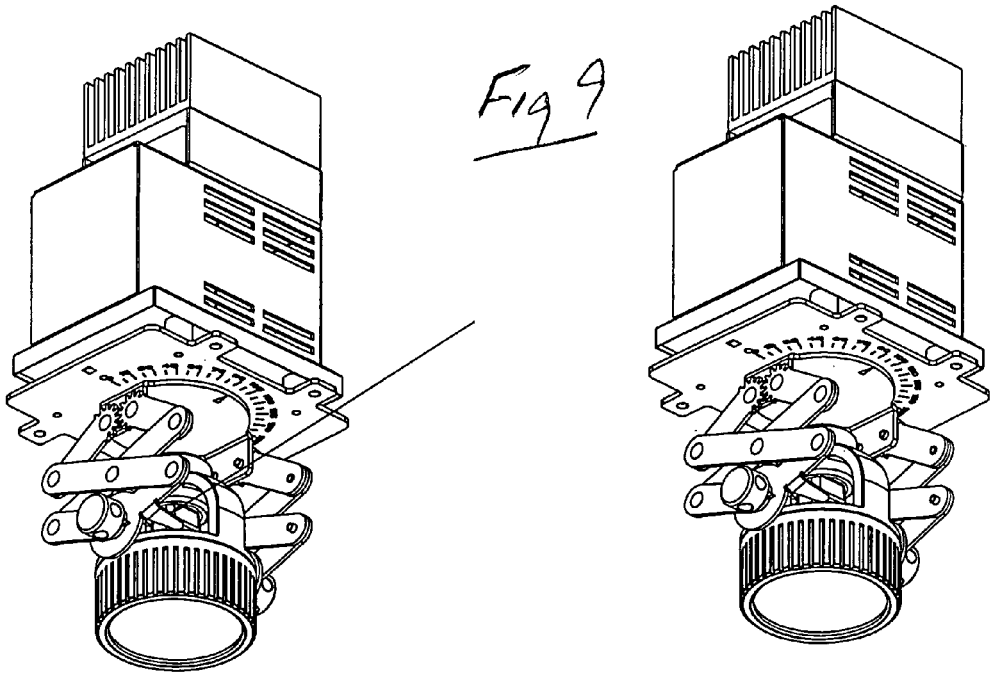
Figure 12:
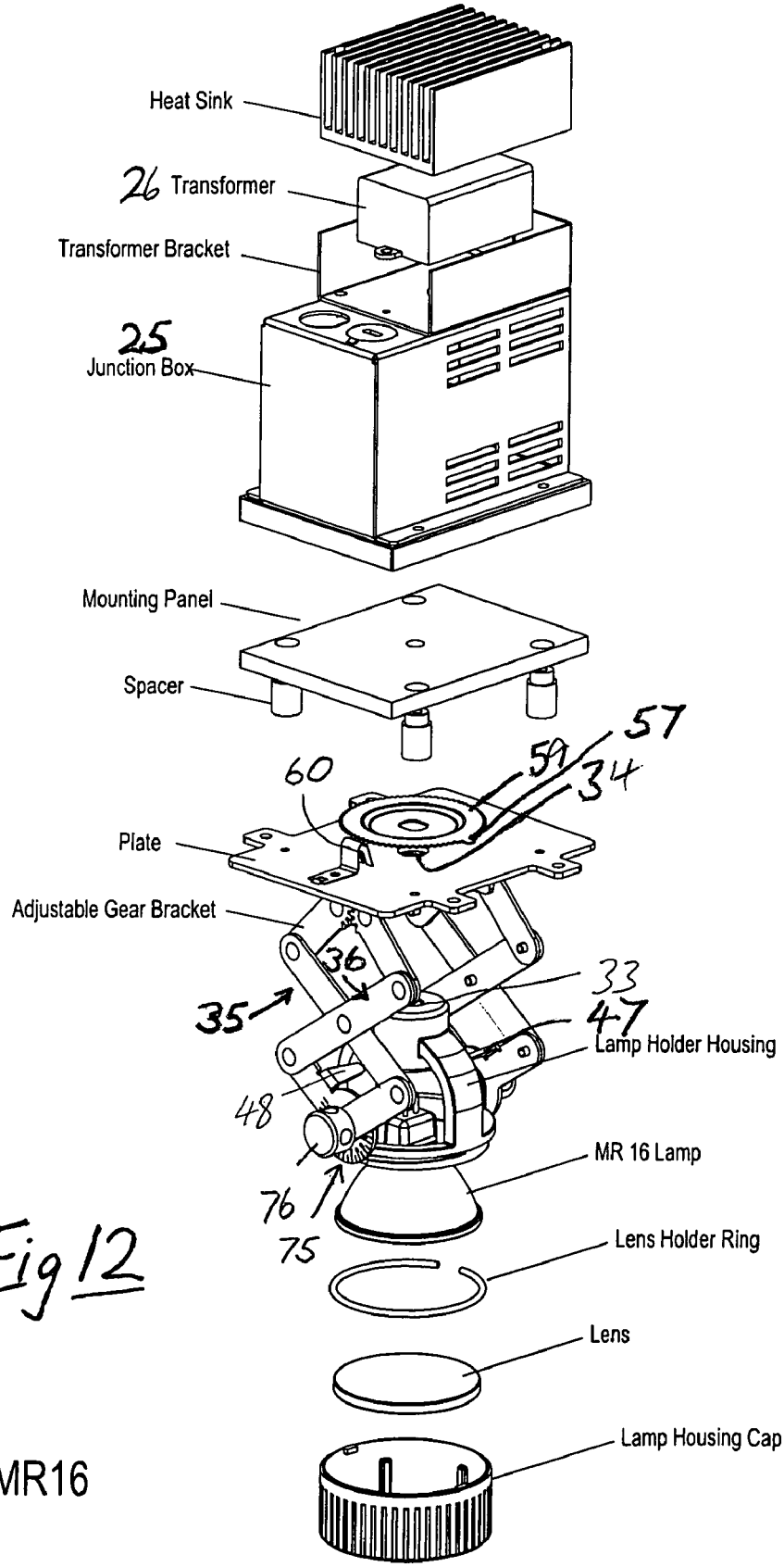
FIG. 12 is an exploded perspective view of another embodiment of downlight assembly module similar to that shown in FIGS. 6-11 but with lamp rotation limiting flanges on edges of lowermost links opposite from those shown in FIGS. 6-11.
Figure 13:
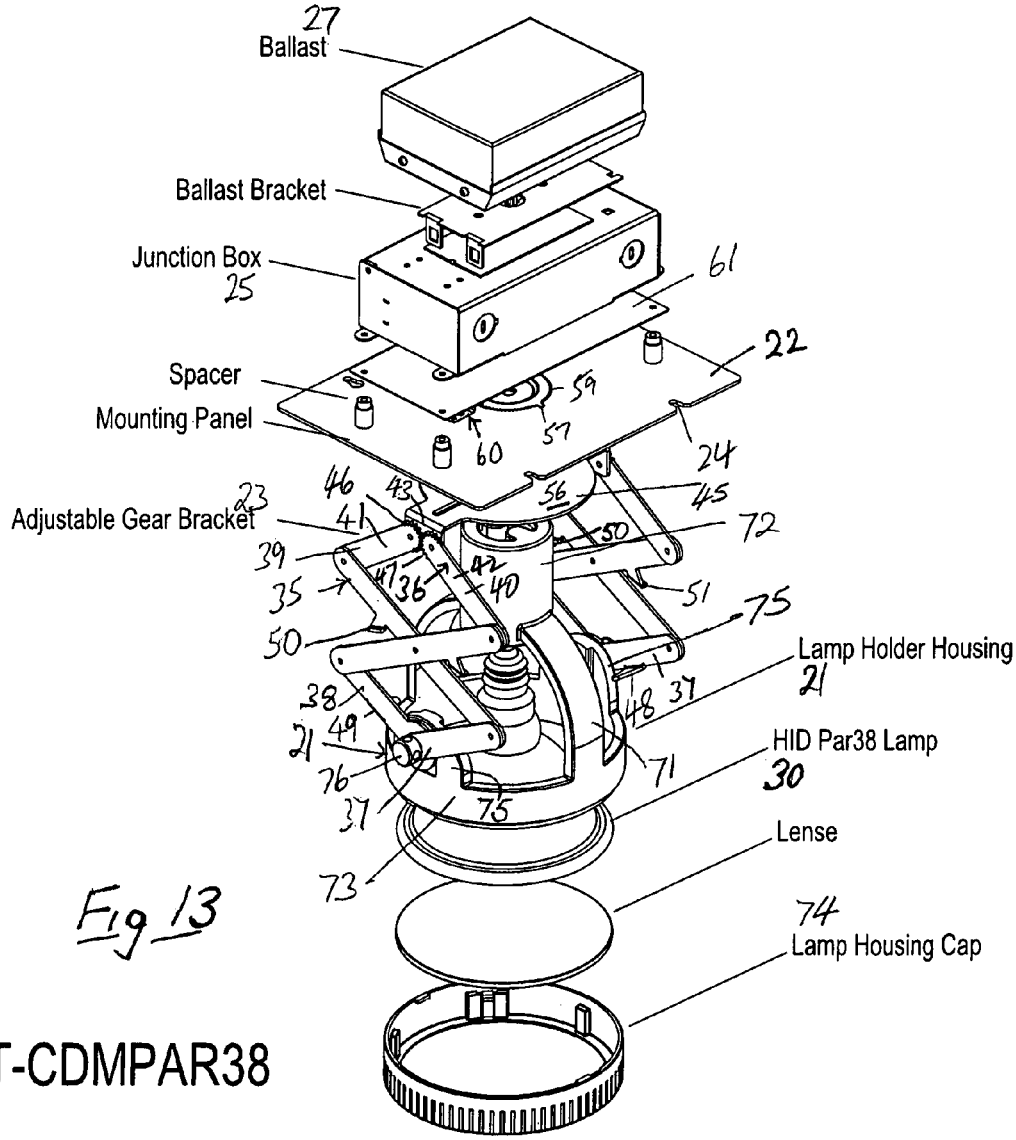
FIG. 13 is an exploded perspective view of another embodiment of downlight assembly module incorporating a ballast power supply on a ballast bracket and additional link motion limiting flanges on links of the scissor suspension mechanism.
Figure 14:
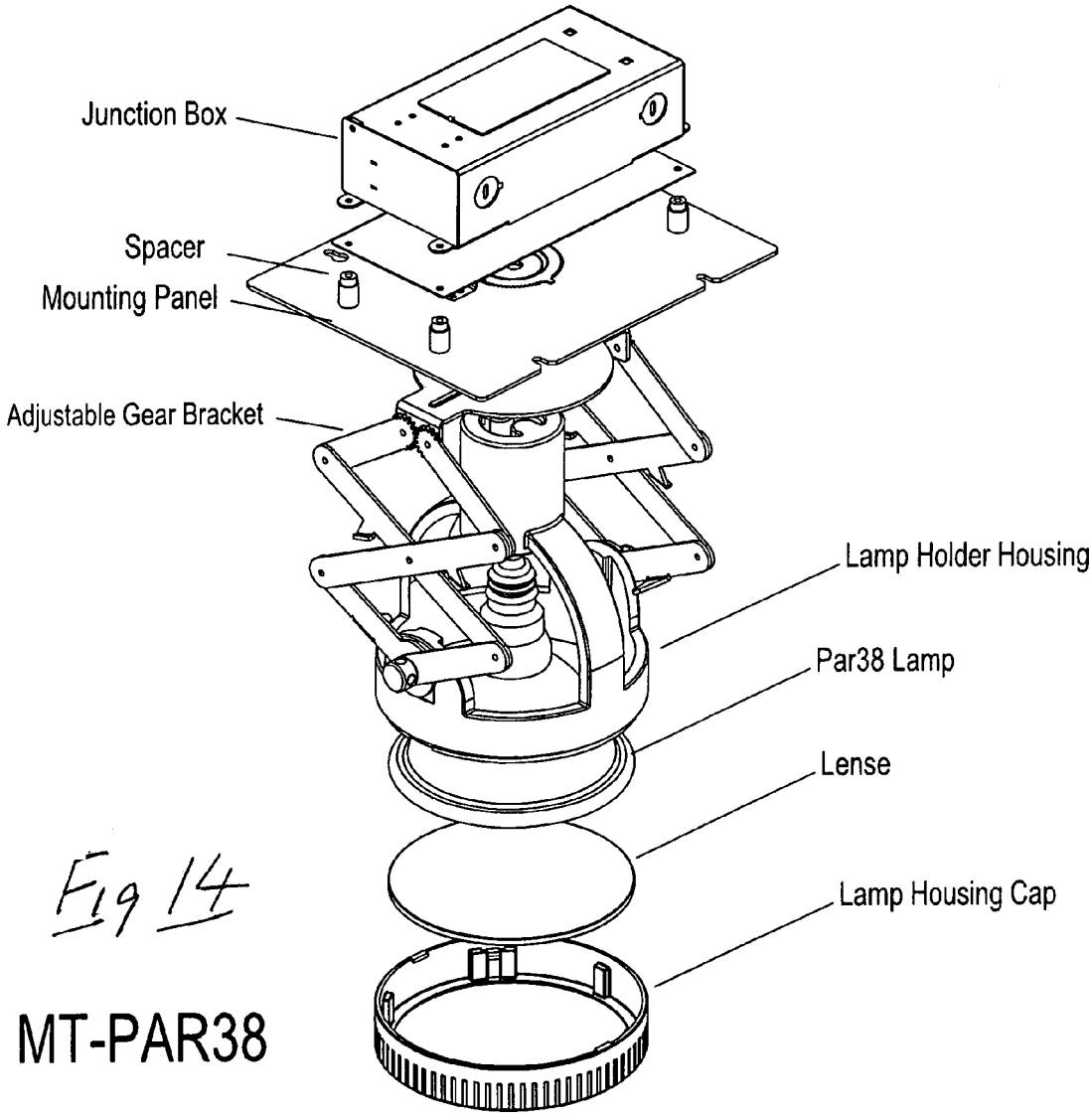
FIG. 14 is an exploded perspective view of a further embodiment of downlight assembly module somewhat similar to FIG. 13 but with the ballast omitted, for example.
Figure 15:
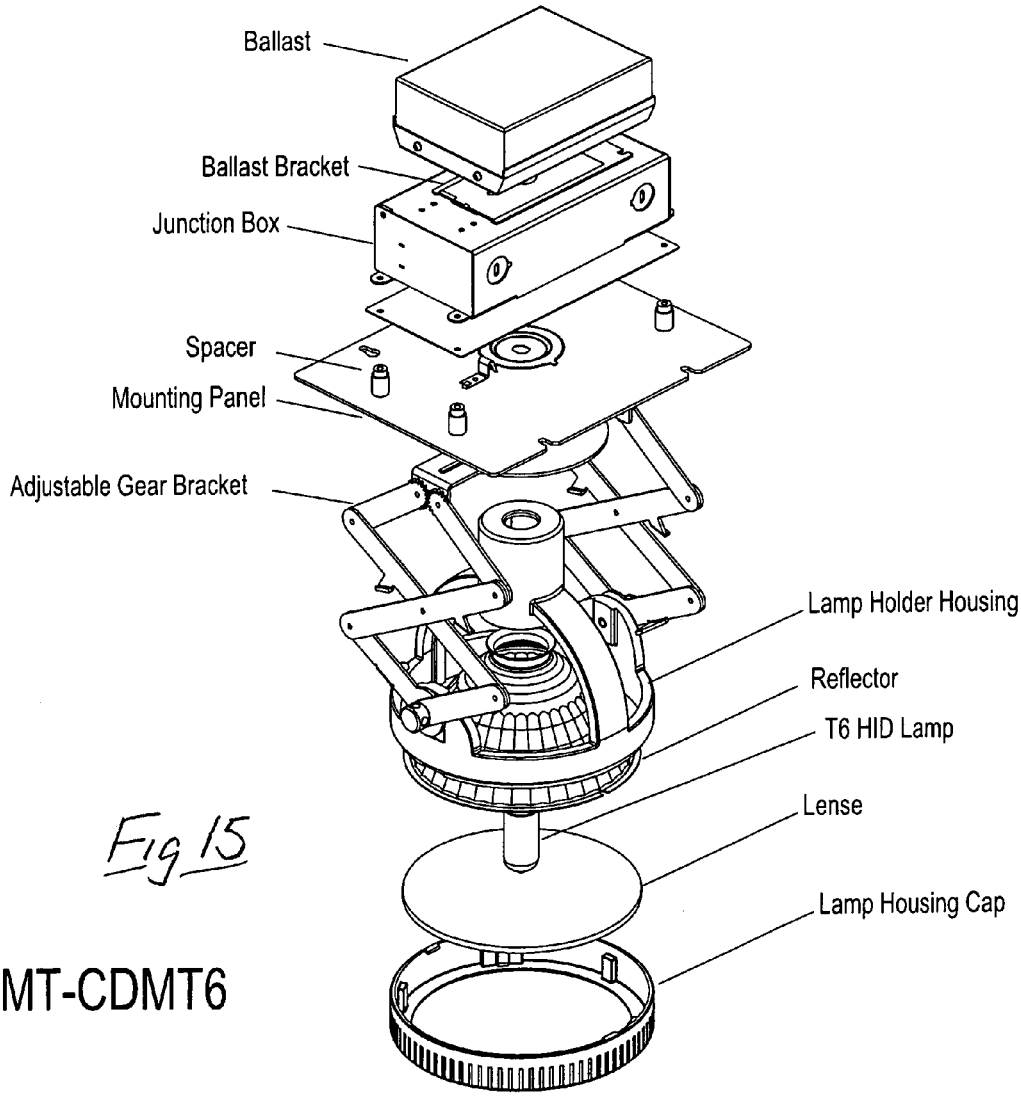
FIG. 15 is an exploded perspective view of a further embodiment of downlight assembly module similar view to that shown in FIG. 14 but with a modified lamp housing holder, lamp and reflector assembly.

A plurality of downlight modules 20 each comprises a lamp holder housing 21 suspended from a lower face of a mounting plate 22 by an extensible scissor/toggle linkage 23. The mounting plates 22 all having module attachment/fastening means (screw holes) 24 at a same location for registration of a mounting plate of a selected module with any selected one of the module attachment/fastening means 17 on the base wall of the back housing. Each downlight module 20 also comprises a junction box 25 mounted to an upper face of each mounting plate 22 which, (in several embodiments, shown in FIGS. 1-12), carries a power supplying transformer 26, (or FIGS. 1,2,4 and 13-15, a ballast 27), the junction boxes 25 and power supplies of all modules having a cross-sectional envelope smaller than any of the apertures 16 in the back housing base. The mounting plates 22 are dimensioned for engagement with the base wall 14 at edge portions of respective apertures so as to cover respective apertures when the mounting means are engaged to mount the selected modules in the back housing 11, with the power supply extending through the aperture 14 above the base wall into the ceiling cavity. Accordingly, a selected, variable, number of modules 20 can be mounted individually in a back housing 11 which has been pre-installed in a ceiling cavity (or dropped ceiling) by inserting the module 20 through the mouth 15 from below, so that the junction box 25 and power supply 26 or 27 are inserted through a selected aperture 16 until a respective mounting plate 22 is brought into covering relation with a respective aperture 16 and the respective attachment/fastening means, screw holes 17, 24, on the mounting plate and base wall are brought into registration when screws can be applied from below to extend through respective screw holes 17 and 24 to fasten the downlight module to the base wall.

Thus, a selected, variable, number of modules can be demounted/removed individually from below from a back housing which remains installed in a ceiling cavity by unscrewing said screws and withdrawing the respective junction boxes and power supplies through the respective apertures 16.

It will be appreciated that it is also necessary to connect and disconnect power wiring (not shown) between the power supplies of individual modules and the back housing.

The lamp holder housing 21 and the mounting plate 22 are provided with electrical lead receiving apertures 23 and 24, respectively, through which power leads extend from the lamp base to the junction box.

The scissor/toggle linkage 23 comprises a dual linkage with respective chains of links 35 and 36 extending in a zig-zag configuration with lowermost end links 37 and 38, respectively, pivotally connected together, at lowermost ends, and to the lamp holder housing 21 for pivotal movement of the lamp 30 about a horizontal axis and having uppermost links 39 and 40, respectively, having respective uppermost ends 41 and 42 pivotally mounted at adjacent locations to respective mounting ears 43 and 44 depending from opposite diametrical locations of a lower disk 56 of a turntable 45 rotatively mounted on the mounting plate 22. The uppermost ends 41 and 42, respectively, of the uppermost links are formed with respective gear teeth 46 and 47, respectively, which are meshed so that the links 39 and 40 move together at a same angular rate during extension or retraction of the linkage to lower or raise the lamp.

A center link of one chain intersects and is pivotally connected to a center link of the other chain for improved synchronous movement and stabilization of the linkages.

Two, similar linkages extend between the lamp holder housing 21 and the mounting plate 22, each dual linkage extending on an opposite side of the lamp holder from the other and each lowermost end link 37 and 38 is formed with a motion limiting flange 48 and 49 which protrudes into the path of pivotal movement of the lamp holder housing 21 thereby to limit the pivotal movement of the lamp holder housing. Additionally, selected motion limiting flanges 50 and 51 are be provided on selected links of respective chains to prevent excessive relative movement thereof.

The lower disk 56 of the turntable 45 is mounted on the lower face of the mounting plate 22 for rotation about a vertical axis permitting rotation of the lamp about a vertical axis.

The perimeter of the turntable is provided with eccentric stop surfaces 57 (FIG. 4) aligned for engagement with stop pins (not seen) staked in the mounting plate to limit rotation of the turntable to prevent damage to the lamp lead.

The lower surface of the mounting plate is marked with angles of rotation as a protractor, and the lower surface of the lower disk is marked with a cooperative arrow for accurate aiming.

The turntable 45 comprises rotation controlling means comprising a perimetrically toothed annulus 59 and a tooth engaging detent 60 mounted cooperatively on an upper face of the mounting plate 22 and joined by a hollow stub shaft or rivet extending though the mounting plate 22 to the lower disk 56, so that the detent successively engages and releases successive teeth during rotation to provide a tensioning effect and enables precise, incremental rotational positioning of the lamp.

The junction box is mounted on a platform like panel 61 mounted, in spaced apart relation on the upper face of the module mounting plate 22 providing clearance for the rotation controlling means received therebetween. Clearance from the mounting plate 22 is provided by the provision of four spacing bushes screw fitted between the mounting plate and the panel 61 (as shown in FIGS. 6-15) or by flange-like feet depending from opposite ends of the panel 61.

The lamp holder housing 21 is made in one-piece with an inverted U-shape yoke 71 diverging from a lamp holder base 72 to free ends joining an annulus 73 which threadingly receives a lense housing cap or bezel 74 and has mounting ears 75 having respective apertures which receive respective tensioning bolts 76 which pivotally mount the lowermost ends of lowermost links to the lamp holder housing to adjust the pivotal stiffness or resistance to pivotal movement of the lamp holder housing. The outer face of at least one ear 75 is marked with degrees, protractor fashion for determining the pivotal angle of the lamp holder housing.

The invention claimed is:

1. A modular downlight assembly comprising:

a back housing for mounting in a cavity formed in one of a conventional ceiling and dropped ceiling comprising a frame of inverted channel section with opposite sidewalls extending downwards from opposite sides of a channel base wall and free, lower ends of the sidewalls defining a channel mouth so that the housing can be mounted in the ceiling cavity with the sidewalls and base concealed within the cavity and the channel mouth opening to below the ceiling;

a plurality of apertures of a same size as each other formed in the base wall for receiving, respectively, when mounted in the cavity, selected individual downlight modules;

respective groups of downlight module attachment means on the base wall spaced around respective apertures, the attachment means of one group being at a similar spacing in respect to an aperture as the spacing of an attachment means of any other group to an aperture;

a plurality of downlight modules each comprising a lamp holder housing suspended from a lower face of a mounting plate by one of an extensible toggle linkage and an extensible scissor linkage;

the mounting plates all having module attachment means at a same location to permit registration and fastening of a mounting plate of any selected module with any selected one of the module attachment means of the back housing;

each downlight module comprising a junction box mounted to an upper face of each mounting plate and carrying a power supply, being one of a transformer and a ballast;

the junction boxes and power supplies of all modules being within a cross-sectional envelope smaller than any one of the apertures in the back housing base wall and the mounting plates being sized for engagement with the base wall at edge portions of respective apertures so as to cover respective apertures when the attachment means on the mounting plates and the base wall are engaged to mount the selected modules in the back housing with the power supply extending through the aperture above the base into the ceiling cavity;

whereby a selected, variable, number of modules can be mounted individually in a back housing which has been installed in the ceiling cavity by inserting, from below, the junction box and power supply through a selected aperture until a respective mounting plate is brought into covering relation with a respective aperture and the attachment means thereof are brought into registration with and operatively engage respective downlight module attachment means on the base wall;

and whereby a selected, variable, number of modules can be demounted and removed individually from below from the back housing which remains installed in the ceiling cavity by disengaging said attachment fastening means from below and withdrawal of the respective junction boxes and power supplies from below through the respective apertures.

2. The modular downlight assembly according to claim 1 wherein each lamp holder housing and mounting plate from which the lamp holder housing is suspended is provided with electrical lead receiving apertures through which power leads extend from a lamp base to the junction box.

3. The modular downlight assembly according to claim 2 comprising means on the back housing for mounting electric power supply leads on the back housing.

4. The modular downlight assembly according to claim 2 wherein each attachment means comprises fastening screw receiving apertures in the mounting plates and base wall, registerable to receive fastening screws from below.

5. The modular downlight assembly according to claim 1 wherein each scissor linkage comprises a dual linkage with two chains of links extending in a zig-zag configuration with lowermost end links having lowermost ends pivotally connected both together and to the lamp holder housing for pivotal movement of the lamp holder housing about a horizontal axis and each scissor linkage having uppermost links with uppermost ends pivotally mounted at adjacent locations to the mounting plate, the uppermost ends of the uppermost links being formed with respective gear teeth which are meshed so that the links move together at a same angular rate during extension or retraction of the scissor linkage to lower or raise the lamp.

6. The modular downlight assembly according to claim 5 wherein a link of one chain of the scissor linkage intersects and is pivotally connected to a link of another chain of the scissor linkage.

7. The modular downlight assembly according to claim 6 wherein a motion limiting flange is provided on a selected link of one chain of the scissor linkage and protrudes into a path of movement of a link of another chain of a same scissor linkage so as to be brought into engagement with said link of another chain by such movement thereby to prevent excessive relative movement of the selected link and said link of another chain of the same scissor linkage.

8. The modular downlight assembly according to claim 7 comprising a plate-form turntable comprising a lower plate mounted on the lower face of the mounting plate for rotation about a vertical axis, uppermost links of respective linkages being pivotally mounted on the turntable to enable rotation of the lamp about a vertical axis.

9. The modular downlight assembly according to claim 8 wherein a perimeter of the turntable is provided with eccentric stop surfaces and stop pins are staked in the mounting plate in alignment with the eccentric stop surfaces to limit rotation of the turntable by engagement with the eccentric stop surfaces.

10. The modular downlight assembly according to claim 8 wherein the lower surface of the mounting plate is marked with indicia providing a protractor and the lower face of the turntable is marked with a pointer for associating with the indicia to indicate an angle of rotation of the turntable and lamp housing.

11. The modular downlight assembly according to claim 5 wherein two similar dual linkages extend between the lamp holder housing and the mounting plate, one dual linkage extending on an opposite side of the lamp holder from another dual linkage and a lowermost link being be formed with a motion limiting flange which protrudes into a path of pivotal movement of the lamp holder housing so as to be brought into engagement with the lamp holder housing by such pivotal movement and thereby limit the pivotal movement of the lamp holder housing.

12. The modular downlight assembly according to claim 11 comprising a plate-form turntable comprising a lower plate mounted on the lower face of the mounting plate for rotation about a vertical axis, uppermost links of respective linkages being pivotally mounted on the turntable to enable rotation of the lamp about a vertical axis.

13. The modular downlight assembly according to claim 12 wherein a perimeter of the turntable is provided with eccentric stop surfaces and stop pins are staked in the mounting plate in alignment with the eccentric stop surfaces to limit rotation of the turntable by engagement with the eccentric stop surfaces.

14. The modular downlight assembly according to claim 12 wherein the lower surface of the mounting plate is marked with indicia providing a protractor and the lower face of the turntable is marked with a pointer for associating with the indicia to indicated an angle of rotation of the turntable and lamp housing.

15. The modular downlight assembly according to claim 1 comprising a plate-form turntable comprising a lower plate mounted on the lower face of the mounting plate for rotation about a vertical axis, uppermost links of respective linkages being pivotally mounted on the turntable to enable rotation of the lamp about a vertical axis.

16. The modular downlight assembly according to claim 15 wherein a perimeter of the turntable is provided with eccentric stop surfaces and stop pins are staked in the mounting plate in alignment with the eccentric stop surfaces to limit rotation of the turntable by engagement with the eccentric stop surfaces.

17. The modular downlight assembly according to claim 15 wherein the lower surface of the mounting plate is marked with indicia providing a protractor and the lower face of the turntable is marked with a cursor for associating with the indicia to indicated an angle of rotation of the turntable and lamp housing.

18. The modular downlight assembly according to claim 15 wherein the plate-form turntable comprises rotation controlling means comprising a perimetrically toothed annulus and a tooth engaging detent mounted cooperatively on the upper face of the mounting plate and joined though the mounting plate to the lower plate, so that the detent successively engages and releases successive teeth during rotation to provide a tensioning effect and enable precise, incremental rotational positioning of the lamp.

19. The modular downlight assembly according to claim 18 wherein the junction box is mounted on a platform mounted, on the upper face of the module mounting plate in spaced apart relation therewith providing a space between the mounting plate and platform in which space the rotation controlling means is located.

20. The modular downlight assembly according to claim 15 wherein a non-planar leaf spring is compressed between opposed surfaces of the mounting plate and the turntable to provide frictional resistance to rotation of the turntable.

* * * * *